US005937249A

United States Patent [19]

Shin

[11] Patent Number: 5,937,249

[45] Date of Patent: Aug. 10, 1999

[54] LIQUID CARRIER WITHDRAWAL APPARATUS FOR LIQUID ELECTROPHOTOGRAPHIC IMAGING SYSTEM

[75] Inventor: Seong-soo Shin, Kyungki-do, Rep. of Korea

[73] Assignee: Samsung Electronic Co., Ltd., Kyungki-do, Rep. of Korea

[21] Appl. No.: 09/076,010

[22] Filed: May 12, 1998

[30] Foreign Application Priority Data

Aug. 1, 1997 [KR] Rep. of Korea ..... 97-36878

[51] Int. Cl.[6] ..... G03G 15/10

[52] U.S. Cl. ..... 399/249

[58] Field of Search ..... 399/249

[56] References Cited

U.S. PATENT DOCUMENTS

| | | | |
|---|---|---|---|
| 5,640,655 | 6/1997 | Shoji | 399/249 |
| 5,752,144 | 5/1998 | Mammino et al. | 399/249 |
| 5,758,237 | 5/1998 | Abramsohn | 399/249 |
| 5,802,436 | 9/1998 | Lang et al. | 399/249 |

*Primary Examiner*—Fred L Braun

*Attorney, Agent, or Firm*—Sughrue, Mion, Zinn, Macpeak & Seas, PLLC

[57] ABSTRACT

A liquid carrier withdrawal apparatus for a liquid electrophotographic imaging system for withdrawing a liquid carrier by separating the liquid carrier from a developer liquid embedded on a photoreceptor for a liquid electrophotographic imaging system. The liquid carrier withdrawal apparatus for a liquid electrophotographic imaging system using a mixed liquid of a toner and a liquid carrier as a developer liquid for developing a latent image formed on a photoreceptor, includes a core rotatably incorporated in the liquid electrophotographic imaging system to be supported thereto and having a cavity formed in its body and a plurality of through holes penetrating from the outer surface of its body to the cavity, an absorbing member coated on the outer surface of the core in contact with the photoreceptor, for absorbing the liquid carrier contained in the developer liquid embedded on the photoreceptor, and liquid carrier exhausting device for introducing the liquid carrier absorbed into the absorbing member into the cavity through the plurality of through holes of the core and exhausting the liquid carrier absorbed into the cavity to the outside of the core. Therefore, the system configuration for withdrawing the liquid carrier becomes simplified and the liquid carrier absorbing power by the absorbing member can be improved.

4 Claims, 3 Drawing Sheets

LIQUID CARRIER WITHDRAWAL APPARATUS FOR LIQUID ELECTROPHOTOGRAPHIC IMAGING SYSTEM

BACKGROUND OF THE INVENTION

1. Field of the Invention

The present invention relates to a liquid carrier withdrawal apparatus for a liquid electrophotographic imaging system for withdrawing a liquid carrier by separating the liquid carrier from a developer liquid embedded on a photoreceptor for a liquid electrophotographic imaging system.

2. Description of the Related Art

In a liquid electrophotographic imaging system such as a printer or copier, adopting a liquid electrophotographic method, a mixed solution of a toner and a liquid carrier is used as the developer liquid for developing a latent image formed on a photoreceptor. As the liquid carrier, hydrocarbon solvents are widely used.

FIG. 1 is a schematic diagram showing important parts of the liquid electrophotographic imaging system.

The liquid electrophotographic imaging system shown in FIG. 1 includes a belt-type photoreceptor 2 driven by a driving roller 1. A latent image is formed on the surface of the photoreceptor 2 by latent image forming means (not shown), and the latent image is developed by a development device 3 using the toner contained in the developer liquid embedded on the latent image portion. After the latent image of the surface of the photoreceptor 2 is developed, a squeegee roller (not shown) incorporated in the development device 3 squeegees the liquid carrier from the developer liquid on the surface of the photoreceptor 2 to then separate the liquid carrier from the photoreceptor 2.

The remaining liquid carrier which is not separated by the squeegee roller is separated from the photoreceptor 2 by a drying roller of the liquid carrier withdrawal apparatus. The drying roller 4, as shown in FIG. 2, includes a core 42 rotatably supported on a shaft 41 fixed on a predetermined support body 9 incorporated in the liquid electrophotographic imaging system, a shielding member 43 coated on the outer surface of the core 42, and an absorbing member 44 coated on the outer surface of the shielding member 43. The shielding member 43 is formed of an oleophobic material so that the oily liquid carrier is prevented from being absorbed into its body. The absorbing member 44 is formed of an oleophilic material such as silicon or polyethylene so that the oily liquid carrier is easily absorbed into its body.

The drying roller 4 is passively rotated by the movement of the photoreceptor 2. When the drying roller 4 is rotated, the liquid carrier contained in the developer liquid embedded on the surface of the photoreceptor 2 is absorbed into the absorbing member 44 of the drying roller 4, thereby separating the liquid carrier from the photoreceptor 2. The liquid carrier absorbed into the absorbing member 44 is prevented from being diffused into the core 42 by the shielding member 43. The liquid carrier absorbed into the absorbing member 44 of the drying roller 4 is then heated by a heating roller 5 (see FIG. 1) and evaporated in a casing 6. The evaporated liquid carrier is exhausted from the casing 6 by a fan 7 together with the air present in the casing 6, and is then sent to a condenser (not shown). The liquid carrier sent to the condenser is liquefied therein prior to withdrawal. The withdrawn liquid carrier may be recycled or disused.

In the conventional liquid carrier withdrawal apparatus having the aforementioned configuration, since a liquid carrier on a photoreceptor is absorbed into only the surface layer of a drying roller, the absorbing capacity for absorbing the liquid carrier is small. Also, since the liquid carrier absorbed into the drying roller is evaporated at the surface of the drying roller by a heating roller, the evaporating efficiency is poor. Also, to prevent the evaporated liquid carrier from being spread into the outside environment, sealing means including a casing must separately be provided to seal the space around the drying roller and the heating roller, so that the overall structure of the imaging system becomes complex. Also, the sealing means causes considerably cumbersome work in repairing or replacing a part such as the drying roller or heating roller. Also, to condense the liquid carrier exhausted from the casing, the liquid carrier and a considerable amount of air exhausted from the casing together with the liquid carrier must be condensed. Thus, the efficiency of the liquid carrier withdrawal apparatus is poor.

SUMMARY OF THE INVENTION

To solve the above problems, it is an objective of the present invention to provide a simplified liquid carrier withdrawal apparatus for a liquid electrophotographic imaging system by improving an exhaust path of the liquid carrier separated from a photoreceptor to then be absorbed into an absorbing member.

Accordingly, to achieve the above objective, there is provided a liquid carrier withdrawal apparatus for a liquid electrophotographic imaging system using a mixed liquid of a toner and a liquid carrier as a developer liquid for developing a latent image formed on a photoreceptor, comprising: a core rotatably supported in the liquid electrophotographic imaging system and having a cavity formed in its body and a plurality of through holes penetrating from the outer surface of its body to the cavity; an absorbing member coated on the outer surface of the core and being in contact with the photoreceptor, for absorbing the liquid carrier contained in the developer liquid embedded on the photoreceptor; and liquid carrier exhausting means for collecting the liquid carrier absorbed into the absorbing member into the cavity through the plurality of through holes of the core and exhausting the liquid carrier absorbed into the cavity to the outside of the core.

BRIEF DESCRIPTION OF THE DRAWING(S)

The above objective and advantages of the present invention will become more apparent by describing in detail a preferred embodiment thereof with reference to the attached drawings in which.

DESCRIPTION OF THE PREFERRED EMBODIMENTS

Figure 1:
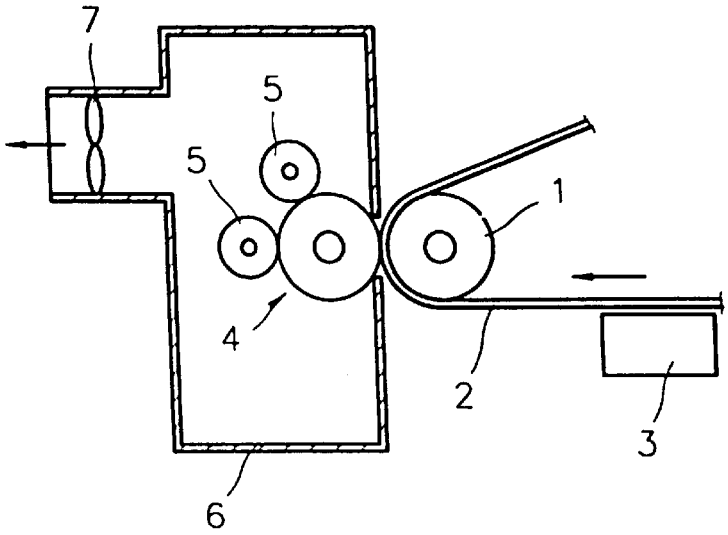
FIG. 1 (PRIOR ART)
FIG. 1 is a schematic diagram of a conventional liquid electrophotographic imaging system.
Figure 2:
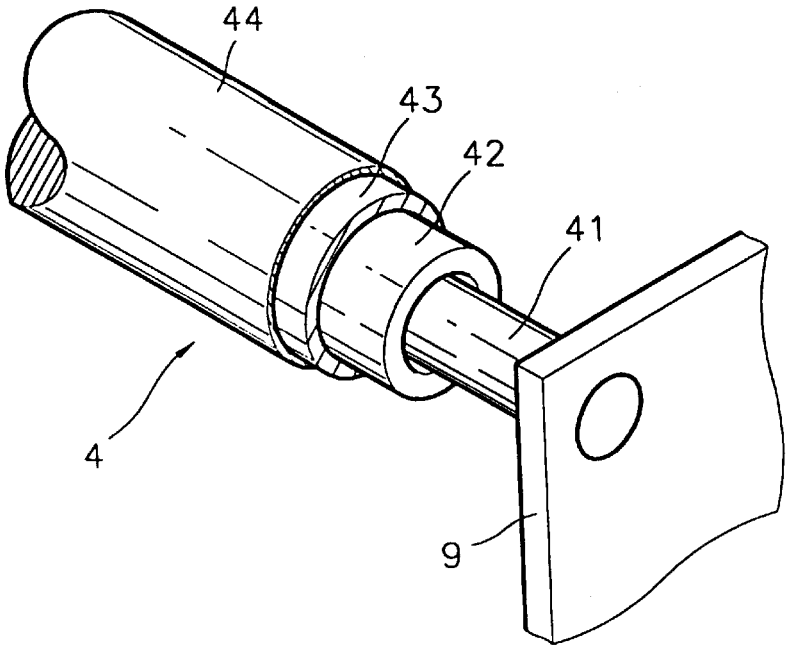
FIG. 2 (PRIOR ART)
FIG. 2 is a schematic perspective view of a drying roller shown in FIG. 1.
Figure 3:
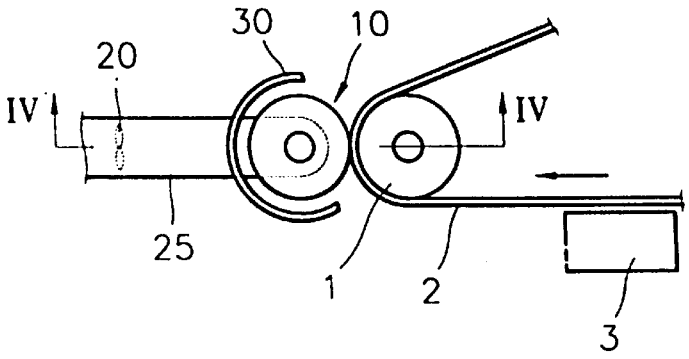
FIG. 3 is a schematic diagram of a liquid electrophotographic imaging system according to the present invention.

In FIG. 3, those parts which are the same as those corresponding to parts in FIG. 1 are designated by the same reference numerals, and their description will be omitted.

Referring to FIG. 3, the liquid carrier withdrawal apparatus according to the present invention includes a drying roller 10, a fan 20 and a heater 30.

Figure 4:
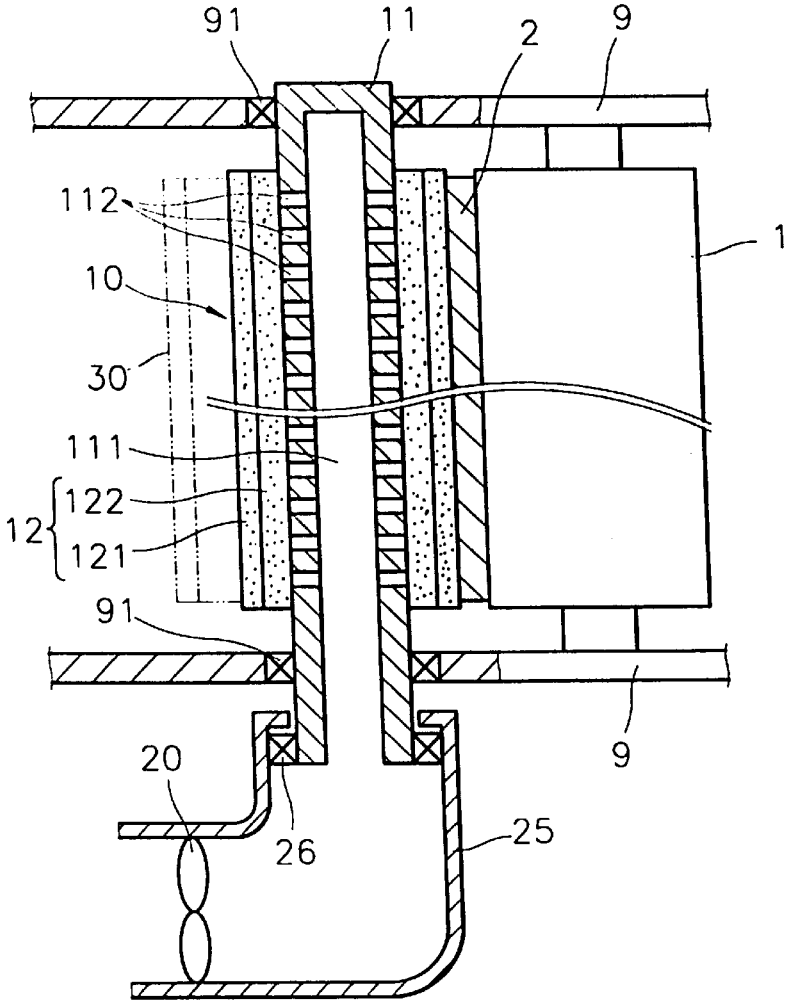
FIG. 4 is a schematic cross-sectional view of a drying roller portion shown in FIG. 3, taken along the line IV—IV.
Figure 5:
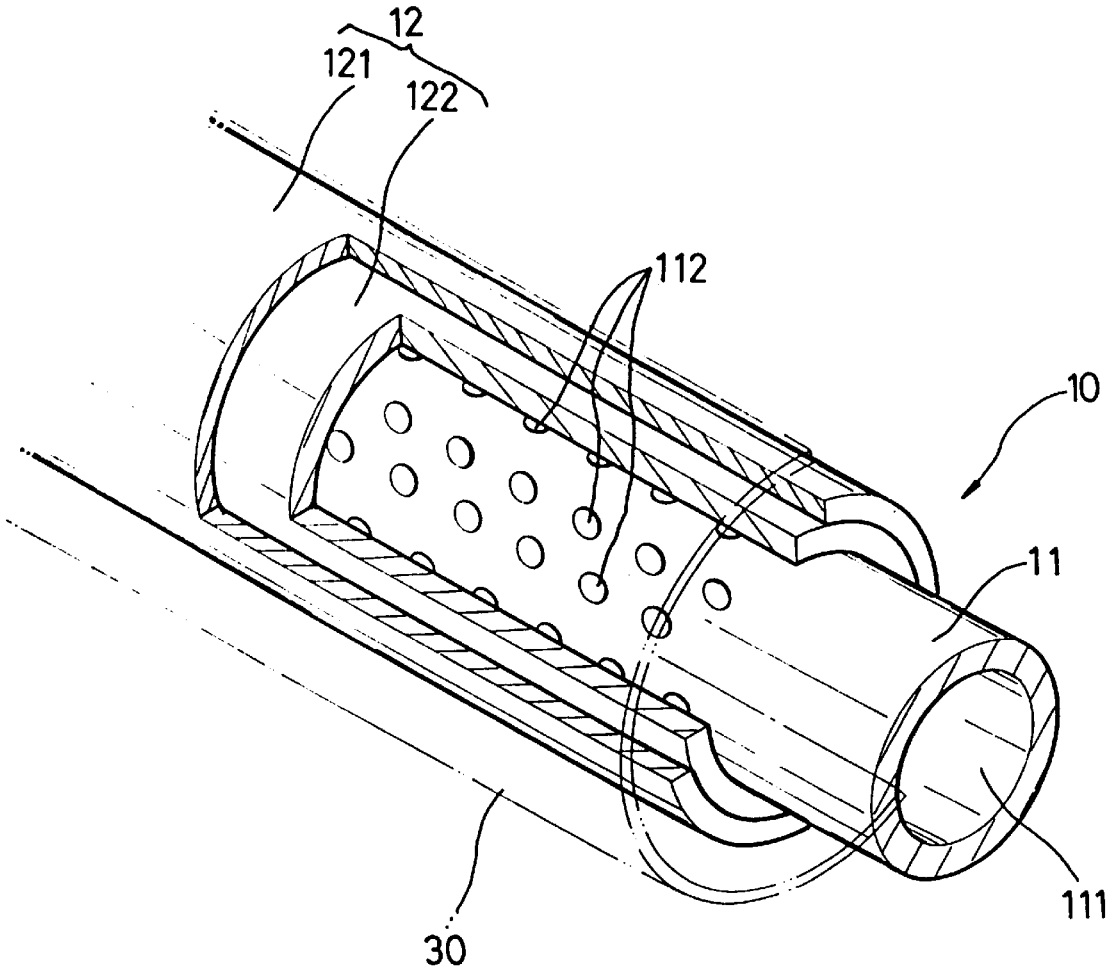
FIG. 5 is a schematic perspective view of the drying roller portion shown in FIG. 4.

The drying roller 10, as shown in FIGS. 4 and 5, includes a core 11 and an absorbing member 12. The core 11 is formed of a metal such as aluminum, both ends of which are rotatably supported to a support body 9 incorporated in a liquid electrophotographic imaging system by a pair of bearings 91. A cavity 111 having an opening in one end of the core 11 is formed within the core 11. Also, a plurality of through holes 112 penetrating from the outer surface of the core 11 to the cavity 111 are formed in the core 11. The absorbing member 12 formed of an oleophilic material so as to absorb the liquid carrier may be formed of one single material. However, in this embodiment, the absorbing member 12 is formed of two different materials forming a first absorbing layer 121 and a second absorbing layer 122, respectively. The first absorbing layer 121 comes into contact with the photoreceptor 2, and the second absorbing layer 122 is positioned between the first absorbing layer 121 and the core 11 and has an absorbing power greater than the first absorbing layer 121. To make the second absorbing layer have the absorbing power greater than the first absorbing layer 121, the first absorbing layer 121 is possibly formed of oleophilic polyethylene and the second absorbing layer 122 is formed of silicon having better oleophilic characteristics than the polyethylene of the first absorbing layer 121. Otherwise, the first absorbing layer 121 is possibly formed of oleophilic silicon and the second absorbing layer 122 is formed of more oleophilic silicon than the silicon used for the first absorbing layer 121.

At one end of the core 11, a duct 25 is reciprocally coupled rotatably with respect to the core 11 by a bearing 26, and a fan 20 is installed within the duct 25. The fan 20 is a liquid carrier exhausting means for introducing the liquid carrier absorbed into the absorbing member 12 into the cavity 111 of the core 11 through the through holes 112 and exhausting the absorbed liquid carrier to the outside of the core 11. The heater 30 is installed in the outer side of the absorbing member 12 of the drying roller 10.

The procedure of withdrawing the liquid carrier using the liquid carrier withdrawal apparatus according to the present invention will now be described.

First, the fan 20 and the heater 30 are operated. In such a state, if the photoreceptor 2 rotates, the drying roller 10 being in contact with the photoreceptor 2 is passively rotated. While the drying roller 10 is rotated, the liquid carrier contained in the developer liquid embedded on the surface of the photoreceptor 2 is absorbed into the first absorbing layer 121 of the absorbing member 12 being in contact with the surface of the photoreceptor 2 so as to be separated from the photoreceptor 2. The liquid carrier absorbed into the first absorbing layer 121 is absorbed into the second absorbing layer 122 having a greater absorbing power than the first absorbing layer 121. As described above, since the absorbing member 12 includes the first and second absorbing layers 121 and 122, the absorption of the liquid carrier occurs quickly and effectively throughout the absorbing member 12.

As the fan 20 operates, the air in the cavity 111 of the core 11 is exhausted to the outside via the duct 25 so that the cavity 111 of the core 11 becomes a vacuum. Accordingly, the liquid carrier absorbed into the absorbing member 12 is heated by the heater 30 and evaporated, and then is absorbed into the cavity 111 through the through holes 112 together with the external air. The liquid carrier introduced into the cavity 111 is exhausted to the outside of the core 11 via the duct 25. The liquid carrier exhausted from the cavity 111 is sent to a condenser (not shown) and liquefied therein for recycling, storage, or disposal like in the conventional liquid carrier withdrawal apparatus.

As described above, in the liquid carrier withdrawal apparatus, the liquid carrier absorbed into the absorbing member 12 is evaporated while being absorbed into the core 11 by the fan 20, and exhausted to the condenser side through the opening end of the core 11. Therefore, since the liquid carrier withdrawal apparatus according to the present invention does not necessitate separate members such as the casing 6 provided for surrounding the space around a drying roller or means for sealing the casing 6, unlike the conventional apparatus, the overall configuration thereof becomes simplified, thereby reducing the cost and facilitating maintenance and repairing. Also, since the liquid carrier on the photoreceptor 2 is subjected to both the absorbing powers of the absorbing member 12 and the fan 20, the liquid carrier contained in the developer liquid is separated from the photoreceptor 2 quickly and efficiently. Since the liquid carrier absorbed into the absorbing member 12 is exhausted to the outside of the drying roller 10 through the cavity 111 of the core 11 by the fan 20, the liquid carrier absorbing power of the absorbing member 12 is improved.

In this embodiment, the absorbing member 12 includes the first absorbing layer 121 and the second absorbing layer 122 formed of a material having better oleophilic characteristics than the first absorbing layer 121. However, even if the absorbing member is formed so as to have the same absorbing power throughout by having a single absorbing layer, the objective of the present invention can be fully achieved.

Also, although the heater 30 has been described to be positioned at the outer side of the drying roller 10 in this embodiment, the heater may be installed between the core 11 and the absorbing member 12 or in the cavity 111 of the core 11. Otherwise, the heater may not be installed. In the case of not installing the heater, the liquid carrier absorbed into the absorbing member 12 is absorbed by the fan 20 in a state in which the liquid carrier is dispersed into the air induced into the cavity 111 of the core 11, by which the objective of the present invention can also be achieved.

As described above, since the liquid carrier withdrawal apparatus for a liquid electrophotographic imaging system is constructed such that the liquid carrier on a photoreceptor, absorbed into an absorbing member, is absorbed into a cavity of a core coated with the absorbing member and then exhausted outside the core, the system for withdrawing the liquid carrier can be simplified and the liquid carrier absorbing power by the absorbing member can be improved.

What is claimed is:

1. A liquid carrier withdrawal apparatus for a liquid electrophotographic imaging system using a liquid mixture of a toner and a liquid carrier as a developer liquid for developing a latent image formed on a photoreceptor, comprising:

a core rotatably supported in the liquid electrophotographic imaging system, said core having a cavity formed within and a plurality of through holes penetrating from an outer surface of said core to the cavity;

an absorbing member formed on the outer surface of said core for absorbing the liquid carrier contained in the developer liquid embedded on the photoreceptor, said absorbing member being in contact with the photoreceptor; and liquid carrier exhausting means for inducing the liquid carrier absorbed into said absorbing member to enter the cavity through the plurality of through holes of said core and exhausting the liquid carrier entering the cavity to the outside of said core and wherein said absorbing member includes a first absorbing layer in contact with the photoreceptor, and a second absorbing layer positioned between the first absorbing layer and said core, the second absorbing layer having a greater absorbing power than the first absorbing layer.

2. The apparatus according to claim 1, further comprising:

a heater for heating the liquid carrier absorbed into said absorbing member.

3. The apparatus according to claim 2, wherein said liquid carrier exhausting means includes a fan for introducing air in the cavity of said core and exhausting the air to the outside of the core.

4. The apparatus according to claim 3, wherein said liquid carrier exhausting means is rotatably coupled to said core.

* * * * *